US007296873B2

(12) United States Patent
Harada et al.

(10) Patent No.: US 7,296,873 B2
(45) Date of Patent: Nov. 20, 2007

(54) PRINTING DEVICE, PRINTING METHOD, PRINTING PROGRAM AND COMPUTER-READABLE RECORDING MEDIUM ON WHICH THE PROGRAM IS RECORDED

(75) Inventors: Seiji Harada, Hachioji (JP); Kenichi Morita, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 266 days.

(21) Appl. No.: 10/774,373

(22) Filed: Feb. 10, 2004

(65) Prior Publication Data

US 2005/0078165 A1 Apr. 14, 2005

(30) Foreign Application Priority Data

Oct. 8, 2003 (JP) ..... 2003-349427
Oct. 8, 2003 (JP) ..... 2003-349428

(51) Int. Cl.
*B41J 2/165* (2006.01)

(52) U.S. Cl. ..... 347/23; 347/19; 347/7; 347/14

(58) Field of Classification Search ..... 347/7, 347/23

See application file for complete search history.

(56) References Cited

U.S. PATENT DOCUMENTS 5,530,461 A * 6/1996 Sakuma ..... 347/23
6,158,837 A 12/2000 Hilton et al.
6,312,072 B1 * 11/2001 Hough ..... 347/7
6,318,828 B1 * 11/2001 Barbour et al. ..... 347/9
6,808,255 B1 * 10/2004 Haines et al. ..... 347/86
6,817,693 B2 * 11/2004 Phillips et al. ..... 347/19

FOREIGN PATENT DOCUMENTS

| | | | |
|---|---|---|---|
| JP | 09-269709 | A | 10/1997 |
| JP | 10-69139 | | 3/1998 |
| JP | 2000-221840 | A | 8/2000 |
| JP | 2001-100530 | | 4/2001 |
| JP | 2001-125462 | | 5/2001 |
| JP | 2002-341703 | A | 11/2002 |
| JP | 2003-162187 | A | 6/2003 |
| JP | 2003-195705 | A | 9/2003 |

* cited by examiner

*Primary Examiner*—Matthew Luu
*Assistant Examiner*—Brian J. Goldberg
(74) *Attorney, Agent, or Firm*—Morrison & Foerster LLP

(57) ABSTRACT

The printer reads a capacity number of printed sheets and a accumulated number of printed sheets of a toner cartridge stored in a cartridge memory of toner cartridge and compares them to determine whether toner cartridge's service life has expired. Similarly, it reads toner cartridge's product information stored in the cartridge memory, and compares it with an authorized product's product information to determine whether the toner cartridge is an authorized product. If it is determined that toner cartridge's life has expired or the toner cartridge is not an authorized product, the printer executes printing process in the safety mode with an increased frequency compared to that of the standard mode. Thus, the printer allows continuation of printing without deteriorating printing quality and without halting instantly even when a toner cartridge, whose service life has expired, or an unauthorized product is used.

30 Claims, 10 Drawing Sheets

FIG. 6

PRINTING CONFIRMATION

THE LOADED TONER CARTRIDGE IS OVERUSED.
IF PRINTING IS CONTINUED WITH THIS CARTRIDGE,
PRINTING QUALITY DETERIORATION OR MACHINE MALFUNCTION MAY OCCUR.

IF IT IS DESIRED TO PRINT WHILE CLEANING PAGE BY PAGE,
PRESS THE PRINTING BUTTON.
IF IT IS DESIRED TO CANCEL THE JOB, PRESS THE CANCEL BUTTON.

PRINTING CANCEL

FIG. 10

PRINTING CONFIRMATION

THE LOADED TONER CARTRIDGE IS NOT AN AUTHORIZED PRODUCT.
IF PRINTING IS CONTINUED WITH THIS CARTRIDGE,
PRINTING QUALITY DETERIORATION OR MACHINE MALFUNCTION MAY OCCUR.

IF IT IS DESIRED TO PRINT WHILE CLEANING PAGE BY PAGE,
PRESS THE PRINTING BUTTON.
IF IT IS DESIRED TO CANCEL THE JOB, PRESS THE CANCEL BUTTON.

PRINTING CANCEL

PRINTING DEVICE, PRINTING METHOD, PRINTING PROGRAM AND COMPUTER-READABLE RECORDING MEDIUM ON WHICH THE PROGRAM IS RECORDED

This application is based on Japanese Patent Application No. 2003-349427 filed on Oct. 8, 2003, and Japanese Patent Application No. 2003-349428 filed on Oct. 8, 2003 the contents of which are hereby incorporated by reference.

BACKGROUND OF THE INVENTION

1. Field of the Invention

The invention related to a printing device. More specifically, it relates to a printing device that allows the printing process to be continued without deteriorating printing quality or without halting the printing operation instantly even when a developing agent cartridge, whose service life has expired or which is not an authorized product, is used.

2. Description of Related Art

The toner cartridge of a printing device such as a printer is a consumable item and it is necessary to replace it with a new cartridge when the toner material stored inside the cartridge is used up. If the used up cartridge is replaced with a cartridge authorized by the manufacturer of said printer ("authorized product"), the printing quality and reliability are guaranteed. However, refilled cartridges that are manufactured by using used-up cartridge bodies of authorized products and refilling them with unauthorized toners or toners of other manufacturers ("refilled product") or cartridges made by other manufacturers in imitation of authorized products ("unauthorized product") are available on the market, and they sometimes caused deterioration of printing quality or reliability or even printer problems. Also, each component of the cartridge has a specific service life, so that even an authorized product is used, it may cause similar troubles when a service life of a part of its components has expired even if its toner has still remained.

In the meanwhile, there are printing device inventions that are capable of judging whether a cartridge is an authorized one depending on the data stored in the cartridge memory (e.g., JP-10-69139A), judging whether a cartridge is a refilled product by detecting increase of the toner quantity recorded on the cartridge memory (e.g., JP-2001-100530A), judging whether a cartridge is a refilled product by detecting damages on the cartridge body making the body impossible to open it without damaging a certain part of it (e.g., Patent Application 2001-125462), and others.

However, in any of these prior arts, it is designed to stop or prohibit printing if the loaded cartridge is found to be a refilled product and the like, so that it has a problem that a user can use a product by mistake without noticing that it is a refilled product, or an authorized product but its service life has expired, or an unauthorized product, in which case the user has no choice to stop printing if a replacement authorized product is not available on the spot.

SUMMARY OF THE INVENTION

The present invention is made under the consideration of such a problem of the prior art, and is intended to provide a printing device that is capable of continuing the printing process without causing such troubles as deterioration of printing quality and reliability or printer malfunctions, etc., even when a refilled product, a cartridge whose service life has expired, or an unauthorized product is used.

Said objective of the present invention can be accomplished by the following means:

(1) A printing device comprising: a judging unit for judging whether a service life of a developing agent cartridge has expired; and an operation mode setting unit for setting up its own operation mode to a safety mode in order to prevent printing troubles when said judgment unit determines that the service life of said developing agent cartridge has expired.

(2) A printing device comprising: a judging unit for judging whether a service life of a developing agent cartridge has expired; and an operation mode setting unit for setting up its own operation mode to a safety mode in which a printing process is executed with an increased cleaning frequency compared to that of a standard mode when said judging unit determines that the service life of said developing agent cartridge has expired.

(3) A printing method comprising: a judging step of judging whether a service life of a developing agent cartridge has expired; and an operation mode setting step of setting up its own operation mode to a safety mode in order to prevent printing troubles when said judgment step determines that the service life of said developing agent cartridge has expired.

(4) A printing method comprising: a judging step of judging whether a service life of a developing agent cartridge has expired; and an operation mode setting step of setting up its own operation mode to a safety mode in which a printing process is executed with an increased cleaning frequency compared to that of a standard mode when said judging step determines that the service life of said developing agent cartridge has expired.

(5) A printing program for causing a printing device to execute: a judging step of judging whether a service life of a developing agent cartridge has expired; and an operation mode setting step of setting up its own operation mode to a safety mode in order to prevent printing troubles when said judgment step determines that the service life of said developing agent cartridge has expired.

(6) A computer-readable recording medium on which the printing program described in (5) is recorded.

(7) A printing device comprising: a judging unit for judging whether a loaded developing agent cartridge is an authorized product; and an operation mode setting unit for setting up its own operation mode to a safety mode in order to prevent printing troubles when said judgment unit determines that said developing agent cartridge is not an authorized product.

(8) A printing device comprising: a judging unit for judging whether a loaded developing agent cartridge is an authorized product; and an operation mode setting unit for setting up its own operation mode to a safety mode in which a printing process is executed with an increased cleaning frequency compared to that of a standard mode when said judgment unit determines that said developing agent cartridge is not an authorized product.

(9) A printing method comprising: a judging step of judging whether a loaded developing agent cartridge is an authorized product; and an operation mode setting step of setting up its own operation mode to a safety mode in order to prevent printing troubles when said judgment step determines that said developing agent cartridge is not an authorized product.

(10) A printing method comprising: a judging step of judging whether a loaded developing agent cartridge is an authorized product; and an operation mode setting step of setting up its own operation mode to a safety mode in which a printing process is executed with an increased cleaning frequency compared to that of a standard mode when said judgment step determines that said developing agent cartridge is not an authorized product.

(11) A printing program for causing a printing device to execute: a judging step of judging whether a loaded developing agent cartridge is an authorized product; and an operation mode setting step of setting up its own operation mode to a safety mode in order to prevent printing troubles when said judgment step determines that said developing agent cartridge is not an authorized product.

(12) A computer-readable recording medium on which the printing program described in (11) is recorded.

BRIEF DESCRIPTION OF THE DRAWINGS

FIG. 6 is a drawing showing an example of dialog to be displayed on a display of a PC 2.

FIG. 10 is a drawing showing an example of dialog to be displayed on a display of a PC 2.

DESCRIPTION OF THE PREFERRED EMBODIMENTS

The preferred embodiments of the invention will be described in detail below with reference to the accompanying drawings.

Figure 1:
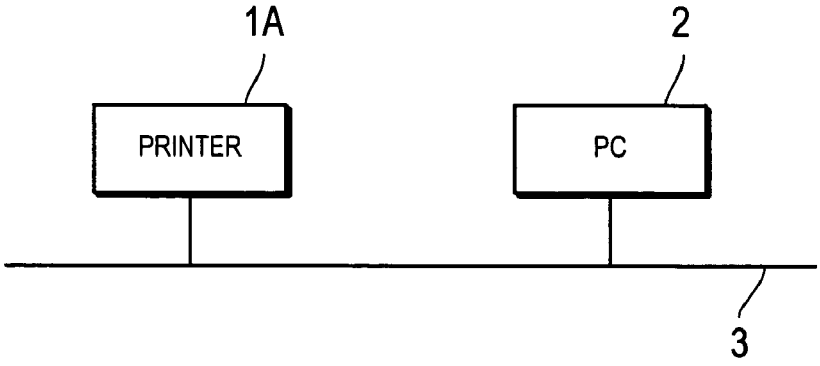
FIG. 1 is a block diagram showing the entire constitution of a printing system including a printing device according to a first embodiment of the present invention.

FIG. 1 is a block diagram showing the entire constitution of a printing system including a printing device according to a first embodiment of the present invention. As shown in FIG. 1, the printing system according to this embodiment is equipped with a printer 1A as a printing device and a PC (personal computer) 2 as a printing job transmission device, which are connected via a network 3 to communicate with each other. The types and the number of equipment to be connected to network 3 are not limited to those shown in FIG. 1.

Figure 2:
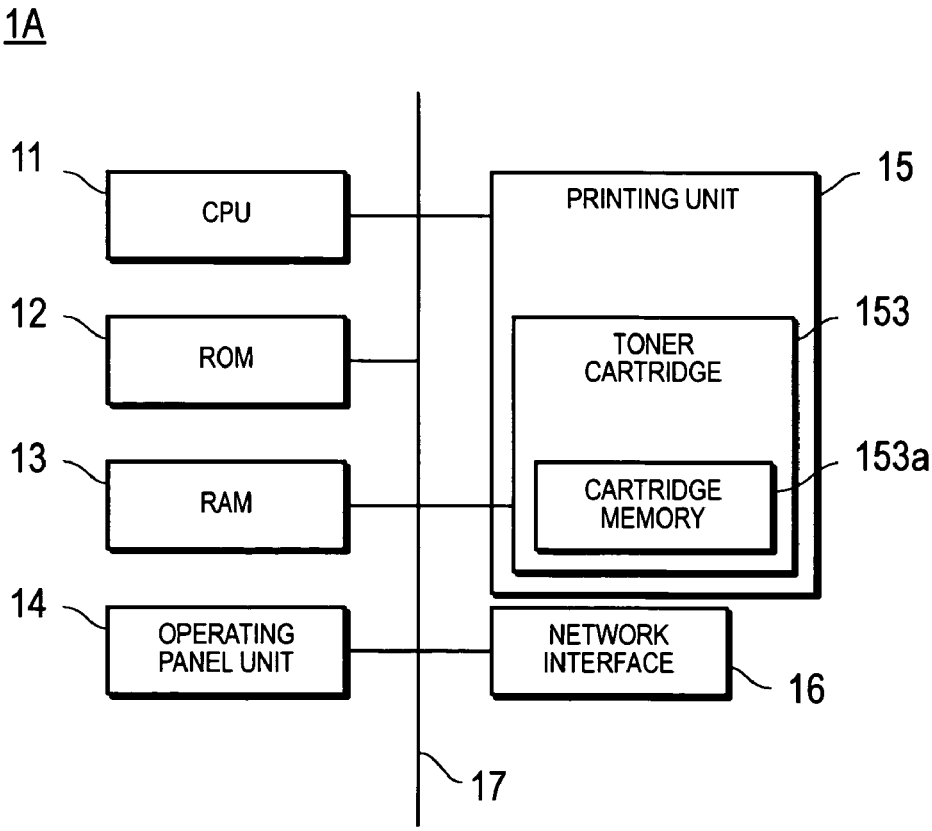
FIG. 2 is a block diagram showing the constitution of a printer 1A.

FIG. 2 is a block diagram showing the constitution of printer 1A according to the present embodiment. As shown in FIG. 2, printer 1A contains a CPU 11, a ROM 12, a RAM 13, an operating panel unit 14, a printing unit 15, and a network interface 16, all of which are interconnected by a bus 17 for exchanging signals.

CPU 11 controls various parts indicated above and executes various arithmetic processes according to a program. ROM 12 stores various programs and parameters for controlling basic operations of printer 1A. RAM 13 stores programs and data temporarily as a working area.

Operating panel unit 14 consists of a display panel, fixed keys, indicator lamps and others used for various inputting and displaying purposes.

Figure 3:
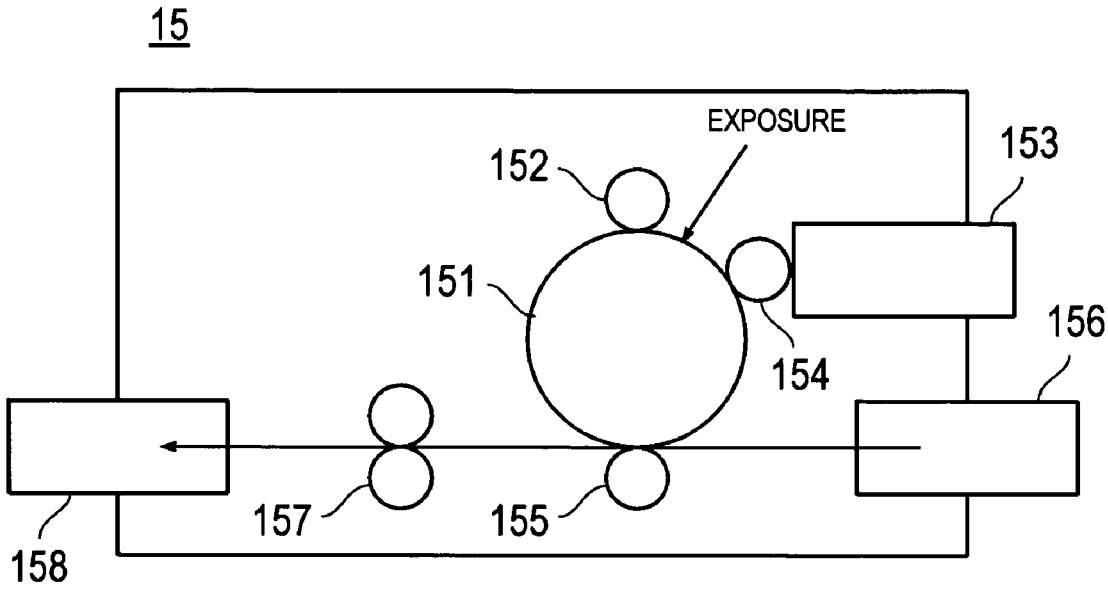
FIG. 3 is a drawing showing the structure of a printing unit 15 of printer 1A.

Printing unit 15 prints image data on printing paper by means of the electronic photograph method. FIG. 3 is a drawing showing the structure of a printing unit 15 of printer 1A. As shown in FIG. 3, printing unit 15 is equipped with a sensitizing drum 151, a charging roller 152, a toner cartridge 153, a developing roller 154, a transfer roller 155, a paper feeding tray 156, a fixing roller 157, and a paper discharge tray 158. When image data is received, printing unit 15 uniformly charges the surface of sensitizing drum 151 by means of charging roller 152, and attaches toner supplied from toner cartridge 153 by means of developing roller 154 to the electrostatic latent images on it, after exposing it with lights on the basis of the received image data. Next, the toner is transferred by transfer roller 155 to a sheet of printing paper transferred from paper feeding tray 156, fixing roller 157 fixes the toner on the paper, and the paper with an image formed on it is discharged to paper discharge tray 158.

In the present embodiment, printing unit 15 is using the cleaner-less method which enables the system to do development and cleaning simultaneously in the developing unit by optimizing the conditions of developing bias potential (JP-9-269709A). Printing unit 15 is capable of executing a cleaning sequence independent of the printing sequence, adjusting the development bias to the optimum level, and rotating sensitizing drum 151 one revolution, to cause the cycle of collecting the toner on sensitizing drum 151, sensitizing drum 152, and transfer roller 155 on the toner cartridge twice in a row, thus achieving the cleaning without fail.

In the present embodiment, toner cartridge 153 is equipped with a cartridge memory 153A with read and write capabilities, and printer 1A is capable of judging whether the service life of the currently loaded toner cartridge has expired or not by accessing a cartridge memory 153A. In other words, the information about the number of sheets that can be printed with said cartridge while maintaining the guaranteed quality, i.e., the service life information that represents the service life of said cartridge, is recorded in a certain area of cartridge memory 153A when it is shipped by the manufacturers plant. Another area of cartridge memory 153A holds the information about the accumulated number of sheets printed using said cartridge up until that time, i.e., the consumption information that represents the amount of usage of said cartridge memory at the present time.

Cartridge memory 153A is connected with bus 17 by signal lines in order to allow printer 1A to access said specified area of cartridge memory 153A to read the capacity number of printed sheets and the accumulated number of printed sheets, and to calculate the consumption rate (consumption rate=capacity number of printed sheets/accumulated number of printed sheets×100). It makes a judgment as to whether the consumption rate has exceeded the threshold value, and determines that the currently loaded toner cartridge's service life has not expired if the consumption rate is lower than the threshold value and that the currently loaded toner cartridge's service life has expired if the consumption rate exceeds the threshold value.

As it is described later, the accumulated number of printed sheets is increased one each time when a page is printed and is never reduced. This way, the consumption rate never returns to zero even when the cartridge is refilled with toner by someone who is not the manufacturer of printer 1A.

Network interface 16 is an interface to connect with a network for communicating with other devices on the network using standards such as Ethernet®, Token Ring, FDDI, etc.

The printer driver for printer 1A is installed on the operation system (OS) of PC2 in order to generate the printing job from the application data and transmit it to printer 1A, monitor the current status of the printing process, or control various settings of printer 1A.

Network 3 can be a LAN connecting computers and network equipment according to standards such as Ethernet®, Token Ring, and FDDI, or a WAN that consists of several LANs connected by a dedicated line.

Figure 4:
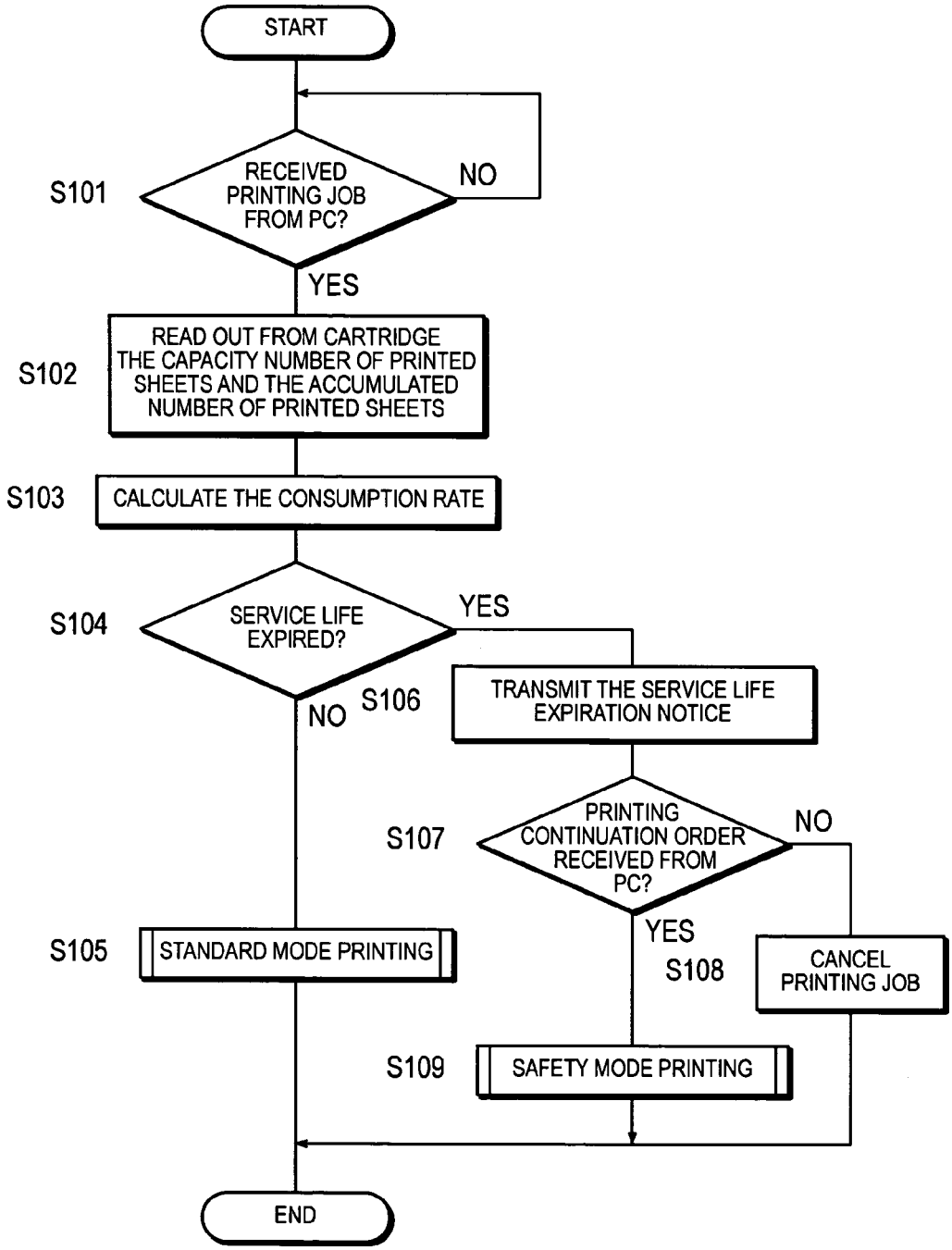
FIG. 4 is a flowchart showing the sequence of printing process by means of printer 1A.

Next, the outline of the printing system according to this embodiment will be described below. FIG. 4 is a flowchart showing the sequence of printing process by means of printer 1A in the present embodiment. The algorithm indicated by the flowchart of FIG. 4 is stored as a control program on ROM 12 of printer 1A, read out by RAM 13, and is executed by CPU 11 when the operation starts.

In FIG. 4, printer 1A waits until it receives the printing job from PC2 (S101: No), accesses the specified area of cartridge memory 153A of toner cartridge 153 of printing unit 15 to read the accumulated number of printed sheets and the capacity number of printed sheets of said toner cartridge onto RAM 13 (S102) when the printing job is received from PC2 via network 3 and network interface 16 (S101: Yes), and calculates the consumption rate from these data (S103). The consumption rate thus obtained is compared with the predetermined threshold value to make a judgment whether said toner cartridge's service life has expired (S104).

Figure 5:
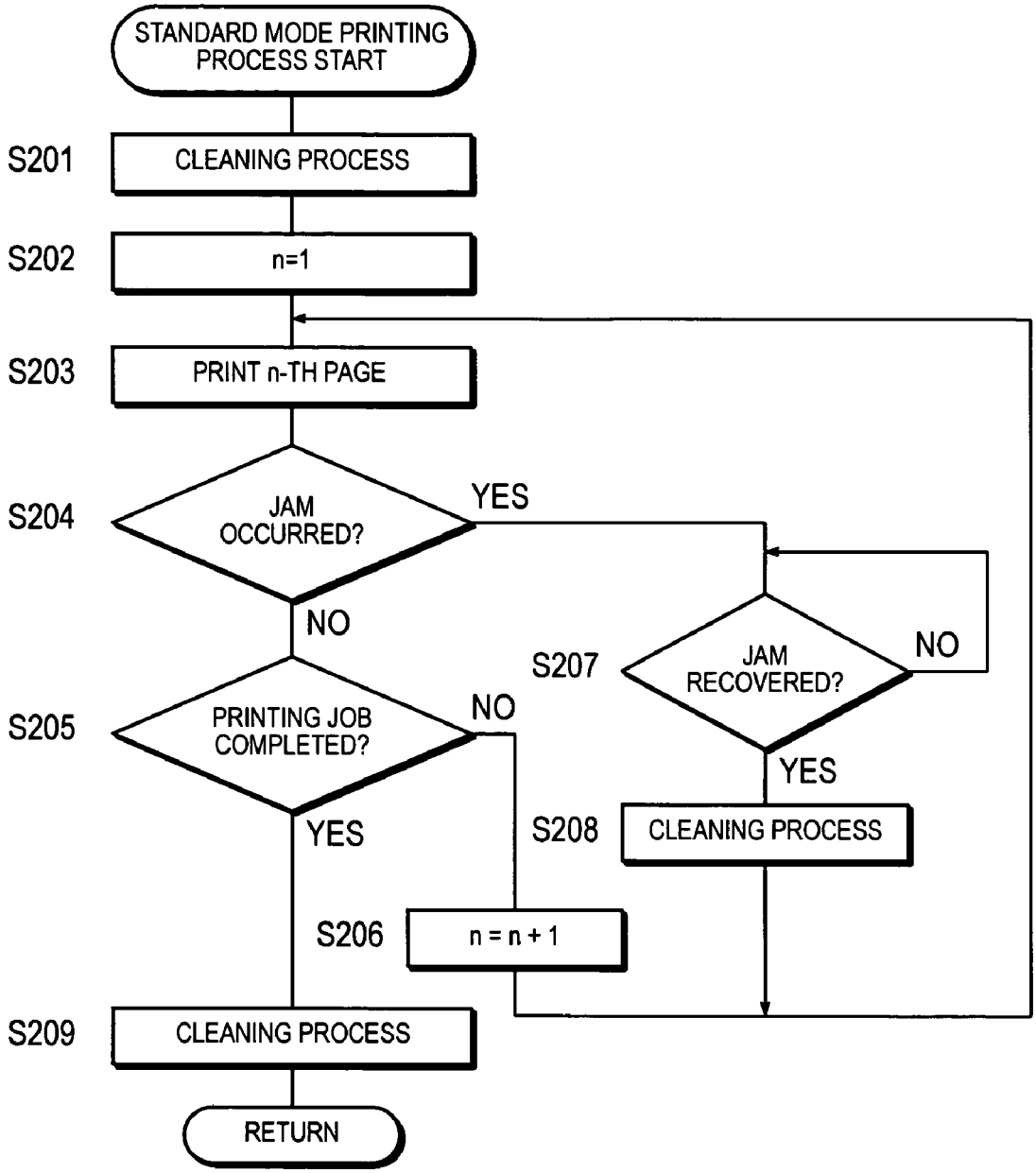
FIG. 5 is a flowchart showing the sequence of the standard mode printing process by means of printer 1A.

If it is judged that the toner cartridge's service life has not expired (S104: No), the standard mode printing process is executed (S105). FIG. 5 is a flowchart showing the sequence of the standard mode printing process by means of printer 1A in the present embodiment. As shown in FIG. 5, printer 1A executes the cleaning process before and after of each printing job as well as during the recovery time when jamming occurs in the standard mode printing.

In other words, printer 1A conducts the cleaning process prior to the printing process for the printing job received in step S101 (S201). Next, the data of the first page of the printing job is rasterized, and the image data obtained is printed and discharged (S202 and S203). If a judgment is made as to whether any jam has occurred (S204) and it is judged that no jam has occurred (S204: No), another judgment is made as to whether the printing process for the printing job is completed (S205), and if it is determined that the printing process has not been completed (S205: No), the printing process of the next page is performed (S206 and S203).

When it is judged that a jam has occurred in step S204 (S204: Yes), it waits until the jam is recovered (S207), and executes the cleaning process (S208) when the jam is recovered with the jammed paper having been removed (S207: Yes), and then executes the same printing process for the same page again (S203). When the entire printing process of the printing job is completed (S205: Yes), executes the cleaning process (S209) to end the standard mode printing process.

On the other hand, if it is determined that the toner cartridge's service life has expired in step S104 (S104: Yes), a service life expiration notice is transmitted to PC 2 via network interface 16 and network 3 (S106).

The printer driver of PC 2 that received the service life expiration notice from printer 1A, displays a dialog as shown in FIG. 6 to notify the user that the loaded toner cartridge's service life has expired to check if the safety mode printing is desired. It waits until the user's instruction is received, and transmits the user's instruction for the printing to be continued or cancelled to printer 1A via network 3.

When printer 1A receives a printing cancellation order from PC 2 via network 3 and network interface 16 (S107: No), it cancels the printing job being processed (S108) to end the printing process.

On the other hand, if it receives from PC 2 an order for continuing the printing process in step S107 (S107: Yes), it executes the safety mode printing process. (S109). The safety mode here means an operating mode for preventing printing troubles, in other words, an operating mode for printing while enhancing the countermeasures against the deterioration of printing quality and reliability, printer malfunctions and the like, which also means increasing the frequencies of cleaning, calibration, and communication with the control center as well as lowering the printing speed in comparison with the standard mode.

Figure 7:
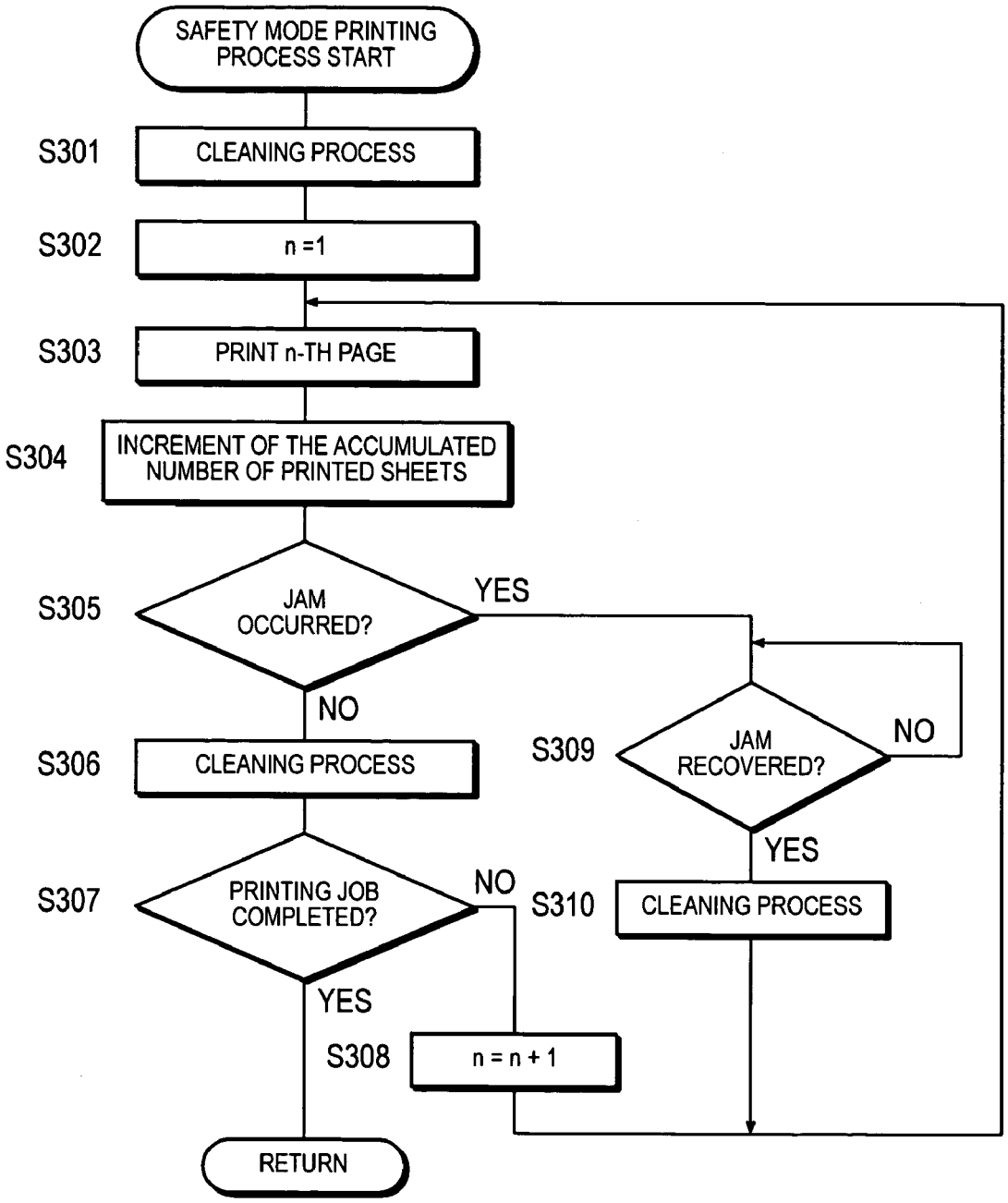
FIG. 7 is a flowchart showing the sequence of the safety mode printing process by means of printer 1A.

FIG. 7 is a flowchart showing the sequence of safety mode printing process by means of printer 1A in the present embodiment. As shown in FIG. 7, printer 1A executes the cleaning process after printing each page as well as prior to each printing job and during the recovery time when jamming occurs in the safety mode printing.

In other words, printer 1A conducts the cleaning process prior to the printing process for the printing job received in step S101 (S301). Next, the data of the first page of the printing job is rasterized, and the image data obtained is printed and discharged (S302 and S303). Next, the accumulated number of printed sheets is incremented by one and is stored in the specified area of the cartridge memory 153A of toner cartridge 153 (S304). If a judgment is made as to whether any jam has occurred (S305) and it is judged that no jam has occurred (S305: No), another judgment is made as to whether the printing process for the printing job is completed (S307) after the cleaning process (S306), and if it is determined that the printing process has not been completed (S307: No), the printing process of the next page is performed (S308 and S303).

On the other hand, if it is judged that a jam has occurred in step S305 (S305: Yes), it waits until the jam is recovered (S309), executes the cleaning process (S310) after the jam is recovered with the jammed paper having been removed (S309: Yes), and then executed the printing process for the same page again (S303). When the printing process of the printing job is all completed (S307: yes), the safety mode printing process is terminated.

Next, the outline of the actions of a printing system equipped with a printing device according to the second embodiment of the present invention will be described. Similar to the printing system according to the first embodiment, the printing system according to this embodiment is equipped with a printer 1B as a printing device and a PC 2 as a printing job transmission device, which are connected via a network 3 to communicate with each other (see FIG. 1). Printer 1B has a similar constitution as printer 1A according to said first embodiment (see FIG. 2).

However, toner cartridge 153 of printer 1B is equipped with a cartridge memory 153B capable of reading and writing in place of cartridge memory 153A, so that printer 1B is capable of making a judgment on whether the loaded toner cartridge is a product authorized by the manufacturer of printer 1B by accessing cartridge memory 153B. More specifically, cartridge memory 153B is connected to bus 17 via electrical signal lines and printer 1B determines that the currently loaded toner cartridge is an unauthorized product when it detects that the loaded toner cartridge does not have a cartridge memory by detecting that said electrical signal lines are not communicating (inactive).

The product information that identifies said printer or said toner cartridge is written in a specified area of cartridge memory 153B upon shipment from the manufacturer. When said signal lines are capable of transmission (active), printer 1B accesses said specified area of cartridge memory 153B to read out the product information, compares the currently read product information with the product information of the authorized product stored in ROM 12, and determines that a toner cartridge of the authorized product is loaded if the current product information matches with that of the authorized product, or determines that a toner cartridge of the unauthorized product is loaded if the current product information does not match with that of the authorized product.

Figure 8:
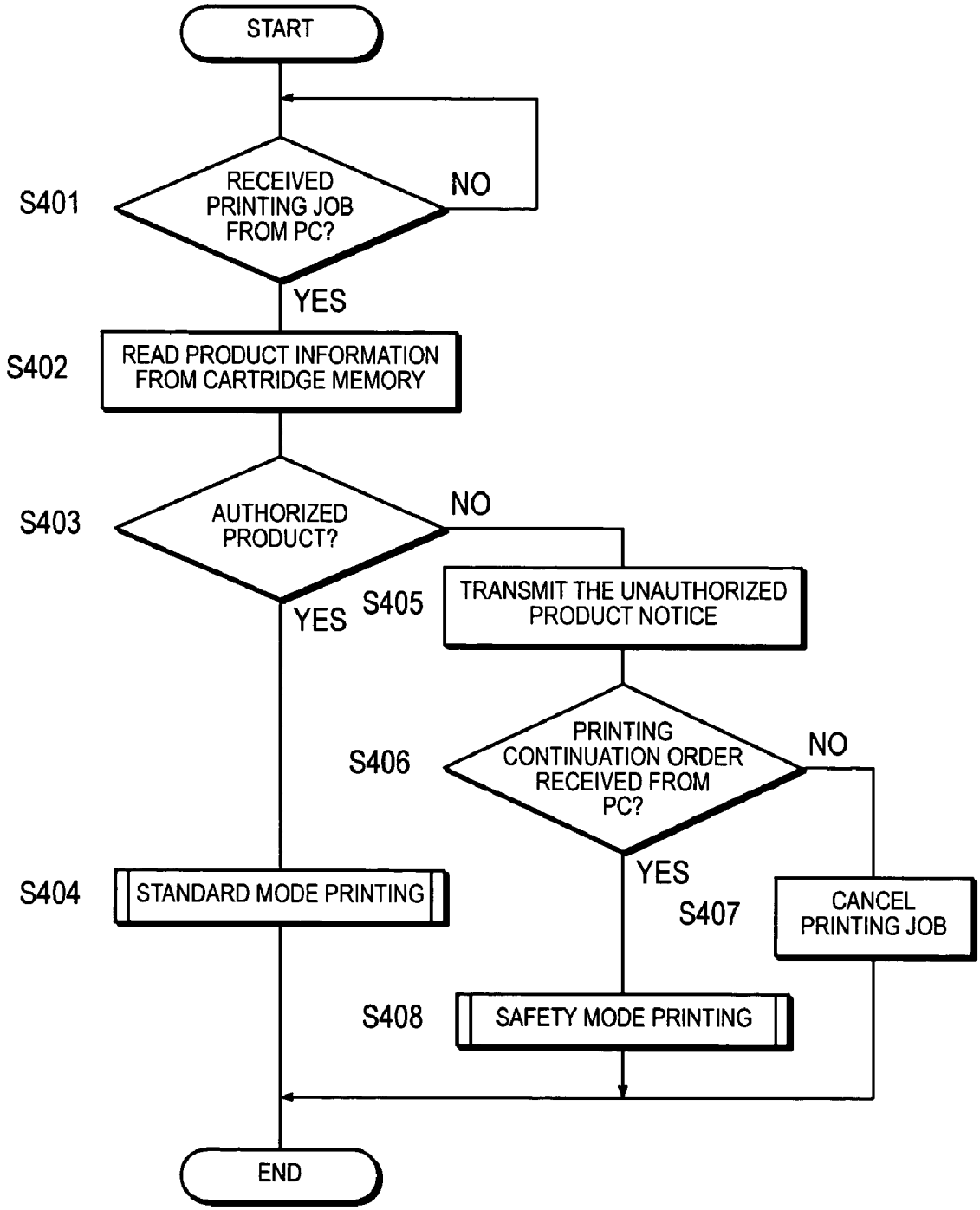
FIG. 8 is a flowchart showing the sequence of printing process of a printer 1B concerning a second embodiment of the invention.

FIG. 8 is a flowchart showing the sequence of printing process by means of printer 1B in the present embodiment. The algorithm indicated by the flowchart of FIG. 8 is stored as a control program on ROM 12 of printer 1B, read out by RAM 13, and is executed by CPU 11 when the operation starts.

In FIG. 8, printer 1B waits until it receives the printing job from PC2 (S401: No), accesses the specified area of cartridge memory 153B of toner cartridge 153 of printing unit 15 to read the product information onto RAM 13 (S402) when the printing job is received from PC2 via network 3 and network interface 16 (S401: Yes), and compares said product information with that of the authorized product to determine if said toner cartridge is an authorized product (S403).

Figure 9:
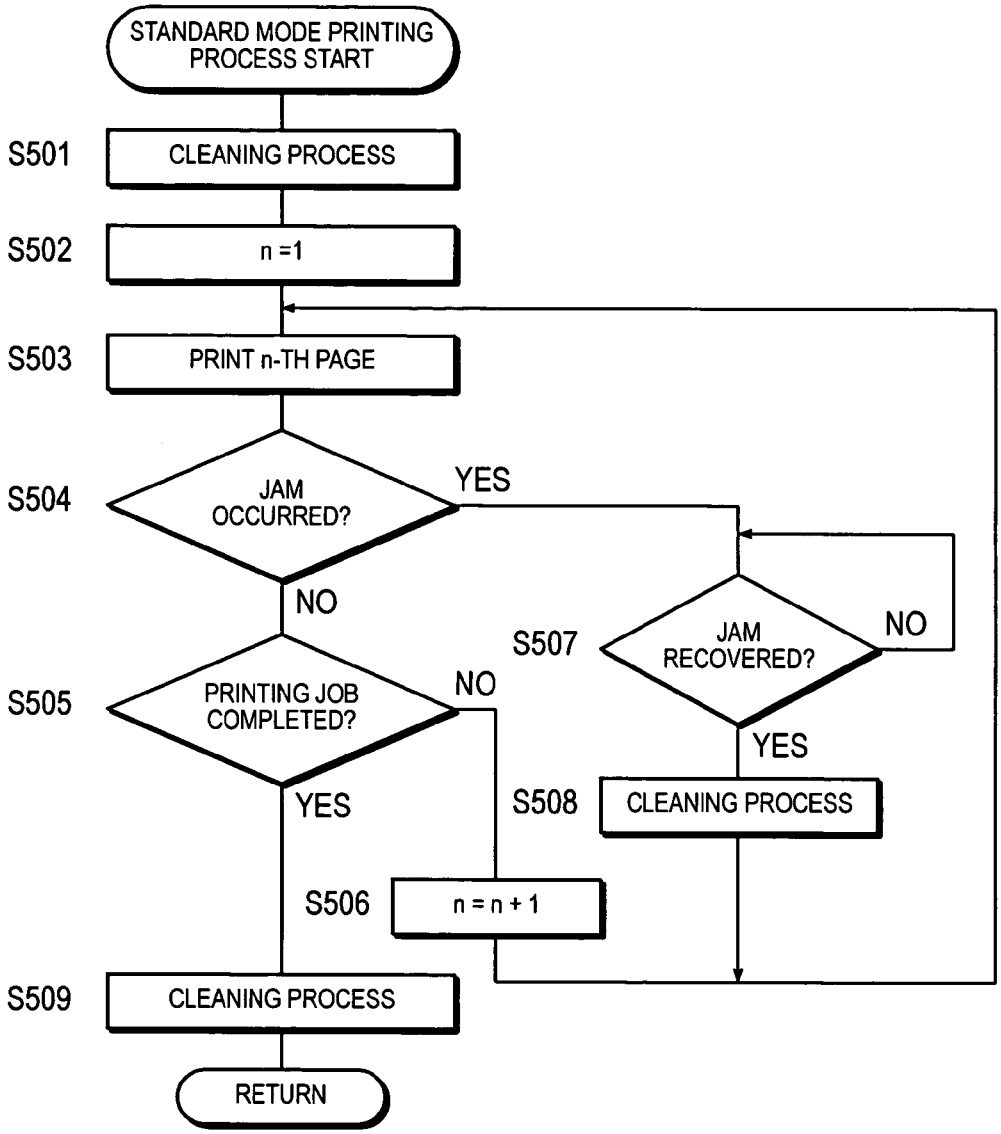
FIG. 9 is a flowchart-showing the sequence of the standard mode printing process by means of printer 1B.

If it is judged that the loaded toner cartridge is an authorized product (S403: Yes), the standard mode printing process is executed (S404). FIG. 9 is a flowchart showing the sequence of the standard mode printing process by means of printer 1B in the present embodiment. As shown in FIG. 9, printer 1B executes the cleaning process before and after of each printing job as well as during the recovery time when jamming occurs in the standard mode printing.

In other words, printer 1B conducts the cleaning process prior to the printing process for the printing job received in step S401 (S501) Next, the data of the first page of the printing job is rasterized, and the image data obtained is printed and discharged (S502 and S503). If a judgment is made as to whether any jam has occurred (S504) and it is judged that no jam has occurred (S504: No), another judgment is made as to whether the printing process for the printing job is completed (S505), and if it is determined that the printing process has not been completed (S505: No), the printing process of the next page is performed (S506 and S503).

When it is judged that a jam occurred in step S504 (S504: Yes), it waits until the jam is recovered (S507), executes the cleaning process (S508) when the jam is recovered with the jammed paper having been removed (S507: Yes), and then executes the same printing process for the same page again (S503) When the entire printing process of the printing job is completed (S505: Yes), executes the cleaning process. (S509) to end the standard mode printing process.

On the other hand, if it is determined that the toner cartridge is not an authorized product in step S403 (S403: No), an unauthorized product notice is transmitted to PC 2 via network interface 16 and network 3 (S405).

The printer driver of PC 2 that received the unauthorized product notice from printer 1B, displays a dialog as shown in FIG. 10 to notify the user that the loaded toner cartridge is not an authorized product to check if the safety mode printing is desired. It waits until the user's instruction is received, and transmits the user's instruction for the printing to be continued or cancelled to printer 1B via network 3.

When printer 1B receives the printing cancellation order from PC 2 via network 3 and network interface 16 (S406: No), it cancels the printing job being processed (S407) to end the printing process.

Figure 11:
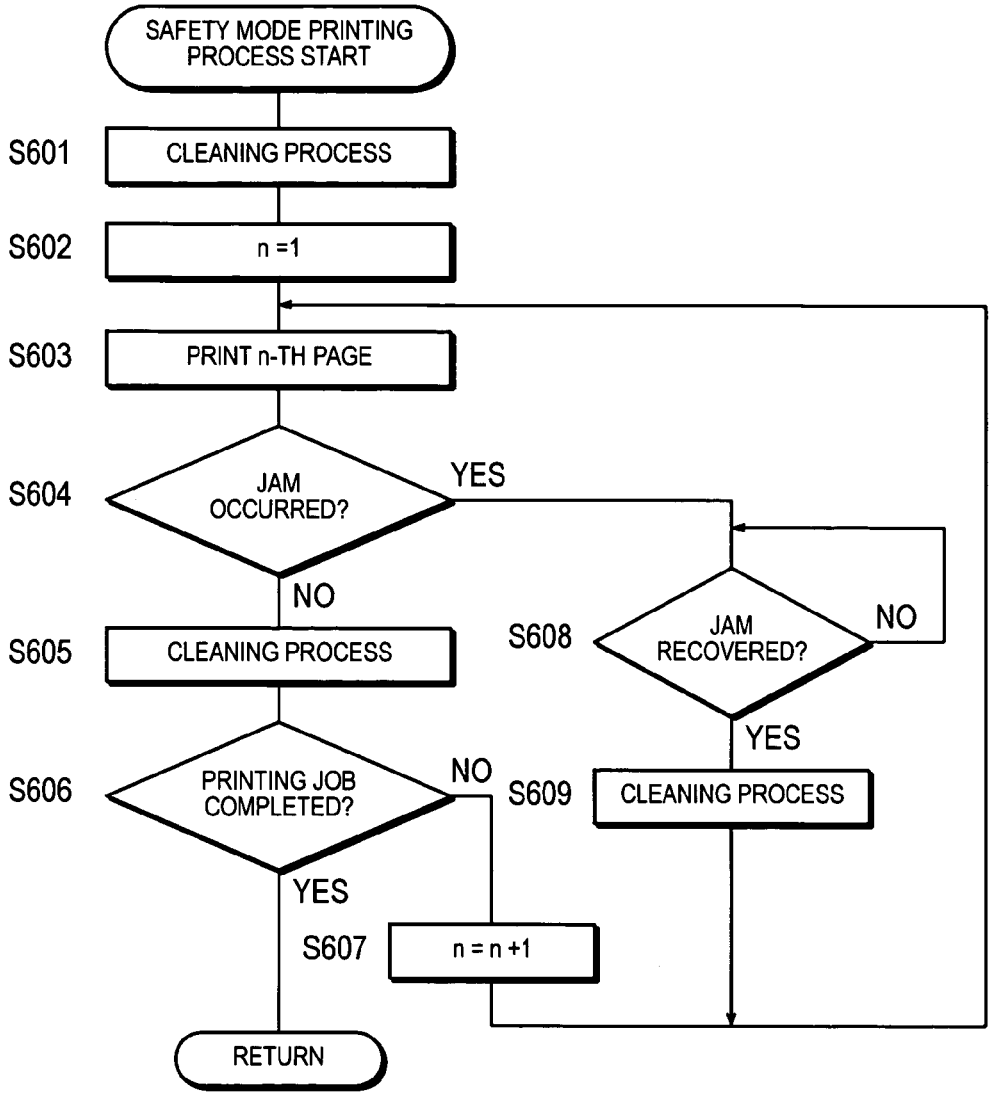
FIG. 11 is a flowchart showing the sequence of the safety mode printing process by means of printer 1B.

On the other hand, if it receives an order for continuing the printing process in step S406 (S406: Yes), it executes the safety mode printing process (S408). FIG. 11 is a flowchart showing the sequence of the safety mode printing process by means of printer 1B in the present embodiment. As shown in FIG. 11, printer 1B executes the cleaning process after printing each page as well as prior to each printing job and during the recovery time when jamming occurs in the safety mode printing.

In other words, printer 1B conducts the cleaning process prior to the printing process for the printing job received in step S401 (S601). Next, the data of the first page of the printing job is rasterized, and the image data obtained is printed and discharged (S602 and S603). If a judgment is made as to whether any jam has occurred (S604) and it is judged that no jam has occurred (S604: No), another judgment is made as to whether the printing process for the printing job is completed (S606) after the cleaning process (S605), and if it is determined that the printing process has not been completed (S606: No), the printing process of the next page is performed (S607 and S603).

On the other hand, if it is judged that a jam has occurred in step S604 (S604: Yes), it waits until the jam is recovered (S608), executes the cleaning process (S609) after the jam is recovered with the jammed paper having been removed (S608: Yes), and then executes the printing process of the same page again (S603). When the printing process of the printing job is all completed (S606: yes), the safety mode printing process is terminated.

The present invention is not limited by the formats of the embodiments presented above, and can be improved or modified in designs without deviating from the gist of the invention.

For example, the printer can be directly connected with PC (locally connected) by means of serial interfaces such as IEEE 1394 and USB, parallel interfaces such as IEEE 1284, or wireless telecommunication standard such as Bluetooth® IEEE 802.11, IrDA, without going through networks.

The printer can be either a monochromatic or color printer. In case of a CMYK four color toner printer, the system can be so constituted to switch to the safety mode printing when one toner cartridge's service life has expired or it is an unauthorized product, or when all four color cartridges' service lives have expired or they are all unauthorized products.

The printer can be of the electronic photograph type or the ink jet type, where, in case of the latter, a judgment is made on whether an ink cartridge's service life has expired or it is an authorized product.

Also, a printer's judgment as to whether a toner cartridge's service life has expired or whether it is an authorized product can be made either when the toner cartridge is loaded, when the electric power is turned on, or at the start of printing, or can be executed multiple times.

The system can also be constituted in such a way that the dialog displayed on the PC, when the toner cartridge's service life has expired or it is an unauthorized product, can include something that were not described in the above embodiments, for example, the choice of the standard mode printing and the safety mode printing.

The dialog display on the PC can be made for each printing instruction or can be made only once. It can also be constituted in such a way that the user can choose whether it should be displayed or not afterwards.

Although the service life information and the consumption information were described in the above embodiments that they were based on the number of sheets to be printed by the printer, they can also be based on the number of effective pixels (number of pixels other than white pixels) used in forming images, or the amount of toner consumed.

Although the service life information was described in the above embodiments that it is read from the cartridge memory of the toner cartridge, it can be the service life information stored preliminarily in the ROM of the printer, etc.

Moreover, in the above embodiments, the safety mode was described as a mode in which printing is executed with an increased frequency of cleaning processes as compared to those of a standard mode, but it can also be a process of printing by increasing the frequency of calibration for compensating the image quality or the frequency of data transmission process for controlling the printing device status to the control center, or a process of printing at a lower speed for reducing the possibility of causing troubles such as jamming. Since a better quality of printing can be achieved by using only the authorized products, it can also have functions of displaying a warning that the present cartridge is an unauthorized or information about stores where the authorized products can be purchased.

Although the printing device was described as a printer in the description of the embodiments, the present invention is not limited to it, and can be an MFP with a printing capability such as a digital copying machine and a facsimile device.

The printing device and the method according to this invention can be realized by a dedicated hardware circuit for executing the abovementioned steps, or by causing a CPU to execute a program where said steps are described. If the present invention is to be materialized by the latter means, said programs for operating the printing device can be provided by computer-readable recording media such as a floppy® disk and CD-ROM, or can be provided on-line via a network such as the Internet. In this case, the program recorded on the computer-readable recording medium is normally transferred to and stored in a memory device such as ROM and a hard disk. The program can also be provided as independent application software or can be built into the software of the printing device as a part of its function.

As can be seen from the above description, the printing device according to the present invention is capable of continuing the printing job without causing such troubles as deterioration of printing quality and reliability or printer malfunctions, when a developing agent cartridge whose service life has expired or a developing agent cartridge of unauthorized product is used.

What is claimed is:

1. A printing device having a sensitizing drum and a developing roller, comprising:

a judgment unit for judging whether a service life of a loaded developing agent cartridge has expired by accessing a memory unit built into said developing agent cartridge, said memory unit storing information concerning the service life of the developing agent cartridge; and an operation mode setting unit for setting an operation mode to a safety mode in order to prevent printing troubles when said judgment unit determines that the service life of said developing agent cartridge has expired;

wherein said safety mode is to execute a printing process with an increased cleaning frequency, an increased calibration frequency or an increased communication frequency with a control center compared to those of a standard mode, the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

2. A printing device described in claim 1, further comprising:

a consumption information reading unit for reading consumption information that represents a consumption rate of said developing agent cartridge at a printed time stored in a memory unit of said developing agent cartridge, wherein said judgment unit determines whether the service life of said developing agent cartridge has expired by comparing the consumption information of said developing agent cartridge read by said consumption information reading unit with preset service life information that represents the service life of said developing agent cartridge.

3. A printing device described in claim 1 wherein said consumption information and service life information are based on a number of printed sheets, a number of effective pixels used in forming images, or an amount of consumed developing agent.

4. A printing device described in claim 1 wherein said developing agent cartridge is either a toner cartridge or an ink cartridge.

5. A printing device having a sensitizing drum and a developing roller, comprising:

a judgment unit for judging whether a service life of a loaded developing agent cartridge has expired by accessing a memory unit built into said developing agent cartridge, said memory unit storing information concerning the service life of the developing agent cartridge; and an operation mode setting unit for setting an operation mode to a safety mode in which a printing process is executed with an increased cleaning frequency compared to that of a standard mode when said judgment unit determines that the service life of said developing agent cartridge has expired, wherein the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

6. A printing device described in claim 5 wherein said cleaning frequency is such that cleaning is executed in every page of image formation.

7. A printing method for printing with a printing device having a sensitizing drum and a developing roller, comprising:

a judgment step of judging whether a service life of a loaded developing agent cartridge has expired by accessing a memory unit built into said developing agent cartridge, said memory unit storing information concerning the service life of the developing agent cartridge; and an operation mode setting step of setting an operation mode to a safety mode in order to prevent printing troubles when said judgment step determines that the service life of said developing agent cartridge has expired;

wherein said safety mode is to execute a printing process with an increased cleaning frequency, an increased calibration frequency or an increased communication frequency with a control center compared to those of a standard mode, the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

8. A printing method described in claim 7, further comprising:

a consumption information reading step of reading consumption information that represents consumption rate of said developing agent cartridge at a printed time stored in a memory unit of said developing agent cartridge, wherein said judgment step determines whether the service life of said developing agent cartridge has expired by comparing the consumption information of said developing agent cartridge read by said consumption information reading step with preset service life information that represents the service life of said developing agent cartridge.

9. A printing method described in claim 7 wherein said consumption information and service life information are based on a number of printed sheets, a number of effective pixels used in forming images, or an amount of consumed developing agent.

10. A printing method described in claims 7 wherein said developing agent cartridge is either a toner cartridge or an ink cartridge.

11. A printing method for printing with a printing device having a sensitizing drum and a developing roller, comprising:

a judgment step of judging whether a service life of a loaded developing agent cartridge has expired by accessing a memory unit built into said developing agent cartridge, said memory unit storing information concerning the service life of the developing agent cartridge; and an operation mode setting step of setting an operation mode to a safety mode in which a printing process is executed with an increased cleaning frequency compared to that of a standard mode when said judgment step determines that the service life of said developing agent cartridge has expired, wherein the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

12. A printing program for causing a printing device having a sensitizing drum and a developing roller to execute:

a judgment step of judging whether a service life of a loaded developing agent cartridge has expired by accessing a memory unit built into said developing agent cartridge, said memory unit storing information concerning the service life of the developing agent cartridge; and an operation mode setting step of setting an operation mode to a safety mode in order to prevent printing troubles when said judgment step determines that the service life of said developing agent cartridge has expired, wherein the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

13. A printing program described in claim 12, further causing a printing device to execute:

a consumption information reading step of reading consumption information that represents a consumption rate of said developing agent cartridge at a printed time stored in a memory unit of said developing agent cartridge, wherein said judgment step determines whether the service life of said developing agent cartridge has expired by comparing the consumption information of said developing agent cartridge read by said consumption information reading step with preset service life information that represents the service life of said developing agent cartridge.

14. A printing program described in claim 12 wherein said consumption information and service life information are based on a number of printed sheets, a number of effective pixels used in forming images, or an amount of consumed developing agent.

15. A printing program described in claim 12 wherein said safety mode is to execute a printing process with an increased cleaning frequency, an increased calibration frequency or an increased communication frequency with a control center, or a reduced printing speed compared to those of a standard mode.

16. A printing program described in claim 12 wherein said developing agent cartridge is either a toner cartridge or an ink cartridge.

17. A computer-readable recording medium on which the printing program described in claim 12 is recorded.

18. A printing device having a sensitizing drum and a developing roller, comprising:

a judgment unit for judging whether a loaded developing agent cartridge is an authorized product; and an operation mode setting unit for setting an operation mode to a safety mode in order to prevent printing troubles when said judgment unit determines that said developing agent cartridge is not an authorized product;

wherein said safety mode is to execute a printing process with an increased cleaning frequency, an increased calibration frequency or an increased communication frequency with a control center compared to those of a standard mode, the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

19. A printing device described in claim 18 further comprising:

a product information reading unit for reading product information for identifying a product of said printing device or said developing agent cartridge stored in a memory unit of said developing agent cartridge, wherein said judgment unit determines whether said developing agent cartridge is an authorized product or not by comparing the product information read by said product information reading unit with a product information of an authorized product.

20. A printing device described in claim 18 wherein said developing agent cartridge is either a toner cartridge or an ink cartridge.

21. A printing device having a sensitizing drum and a developing roller, comprising:

a judgment unit for judging whether a loaded developing agent cartridge is an authorized product; and an operation mode setting unit for setting an operation mode to a safety mode in which a printing process is executed with an increased cleaning frequency compared to that of a standard mode when said judgment unit determines that said developing agent cartridge is not an authorized product, wherein the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

22. A printing device described in claim 21 wherein said cleaning frequency is such that cleaning is executed in every page of image formation.

23. A printing method for printing with a printing device having a sensitizing drum and a developing roller, comprising:

a judgment step of judging whether a loaded developing agent cartridge is an authorized product; and an operation mode setting step of setting an operation mode to a safety mode in order to prevent printing troubles when said judgment step determines that said developing agent cartridge is not an authorized product;

wherein said safety mode is to execute a printing process with an increased cleaning frequency, an increased calibration frequency or an increased communication frequency with a control center compared to those of a standard mode, the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

24. A printing method described in claim 23 further comprising:

a product information reading step of reading product information for identifying a product of said printing device or said developing agent cartridge stored in a memory unit of said developing agent cartridge, wherein said judgment step determines whether said developing agent cartridge is an authorized product or not by comparing the product information read by said product information reading step with a product information of an authorized product.

25. A printing method described in claim 23 wherein said developing agent cartridge is either a toner cartridge or an ink cartridge.

26. A printing method for printing with a printing device having a sensitizing drum and a developing roller, comprising:

a judgment step of judging whether a loaded developing agent cartridge is an authorized product; and an operation mode setting step of setting an operation mode to a safety mode in which a printing process is executed with an increased cleaning frequency compared to that of a standard mode when said judgment step determines that said developing agent cartridge is not an authorized product, wherein the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

27. A printing method described in claim 26 wherein said cleaning frequency is such that cleaning is executed in every page of image formation.

28. A computer-readable medium storing a printing program for causing a printing device having a sensitizing drum and a developing roller to execute:

a judgment step of judging whether a loaded developing agent cartridge is an authorized product; and an operation mode setting step of setting an operation mode to a safety mode in order to prevent printing troubles when said judgment step determines that said developing agent cartridge is not an authorized product, wherein said safety mode is to execute a printing process with an increased cleaning frequency, an increased calibration frequency or an increased communication frequency with a control center compared to those of a standard mode, the printing device prints by an electronic photograph method and collects toner remaining on the sensitizing drum by using the developing roller while rotating the sensitizing drum as a sequence independent of a printing sequence to clean the sensitizing drum, and when the printing device increases cleaning frequency in the safety mode compared to the standard mode, the printing device executes a cleaning process per printing job in the standard mode and executes a cleaning process per printing page in the safety mode.

29. A printing program described in claim 28 further causing a printing device to execute:

a product information reading step of reading product information for identifying a product of said printing device or said developing agent cartridge stored in a memory unit of said developing agent cartridge, wherein said judgment step determines whether said developing agent cartridge is an authorized product or not by comparing the product information read by said product information reading step with a product information of an authorized product.

30. A printing program described in claim 28 wherein said developing agent cartridge is either a toner cartridge or an ink cartridge.

* * * * *